United States Patent [19]

Seidl

[11] Patent Number: 4,536,133

[45] Date of Patent: Aug. 20, 1985

[54] REGULATABLE VANE PUMP

[75] Inventor: Günther Seidl, Heubach, Fed. Rep. of Germany

[73] Assignee: Zahnradfabrik Friedrichshafen, AG., Friedrichshafen 1, Fed. Rep. of Germany

[21] Appl. No.: 592,475

[22] Filed: Mar. 22, 1984

[51] Int. Cl.[3] ..... F04B 49/08; G05D 11/00

[52] U.S. Cl. ..... 417/307; 417/310; 137/115; 137/117

[58] Field of Search ..... 417/296, 299, 300, 307, 417/308, 310; 137/115, 117

[56] References Cited

U.S. PATENT DOCUMENTS

| | | | |
|---|---|---|---|
| 2,462,983 | 3/1949 | MacDuff et al. | 137/117 |
| 3,253,607 | 5/1966 | Drutchas | 417/310 X |
| 3,404,634 | 10/1968 | Connelly | 417/310 X |
| 3,645,647 | 2/1972 | Ciampa et al. | 417/310 X |

*Primary Examiner*—Carlton R. Croyle

*Assistant Examiner*—Theodore W. Olds

*Attorney, Agent, or Firm*—Zalkind & Shuster

[57] ABSTRACT

A regulatable vane pump is provided with regulating apparatus incorporated in the pump having a differential pressure piston operable responsive to booster steering flow demand wherein the piston carries a flexible leaf spring having a flat surface which serves as a shut off member against ports in a restrictor member. Actuation of the regulating piston carries the leaf spring toward the ported member to progressively shut off restrictor ports in the face of the ported member, either partially or fully depending upon the ported arrangement. As ports are gradually closed off regulation of the pump discharge is effected at various demand pressures after linear rise of rate of discharge up to a regulating point. Thereafter, there is wide separation of characteristics of regulating curves or lines for differing pressure demands. The overall effect produces a precise regulation within narrow limits as well as an economy of manufacture.

12 Claims, 8 Drawing Figures

REGULATABLE VANE PUMP

BACKGROUND OF THE INVENTION

Vane pumps are used very frequently especially for the supply of pressure oil to auxiliary power steering systems. For regulation of pressure flow for auxiliary power steering, it has been known to restrict pump flow pressure passage adjacent the pump outlet which increases the flow speed and thus decreases the static pressure on one side, viz., the rear side of the flow regulating piston. Accordingly, pressure on one surface of a regulator piston becomes relatively greater i.e., on the upstream face directly exposed to outlet chamber pressure and the flow regulating piston experiences an opening force due to differential pressuer, depending on pump speed. Such piston movement opens a passage from pump outlet to pump inlet increasing the pump circulation between outlet and inlet and decreasing flow to a consumer device, e.g., a power steering system. Thus, on a graph of pump discharge (ordinate) plotted against speed (abscissa) a dropping characteristic line occurs, i.e., the pump discharge is not increased corresponding to the speed increase at the beginning of regulation, but is reduced.

Separation of characteristic lines are desirable for various reasons. Thus, for example, a decreasing characteristic line for auxiliary power steering at high rpms results in a better steering function. Moreover, the circulating pressure flow in the steering system decreases with a dropping characteristic for flow with rising rpms. The consequence is a lesser working effort of the pump which effects a lower operation temperature.

In the German OS No. 22 65 097 (U.S. Pat. No. 3,728,046) and the German OS No. 26 52 707, it has been known in the regulation of the pump flow to provide a flow regulating piston with a tapered conical flow control pin movably projecting into a housing restrictor bore. The varying diameter of the pin during movement of the flow regulating piston, effects an annular restrictor toroidal flow passage variable in cross section resulting from pressure actuation of the flow regulating piston. The course of the characteristic curve of flow after the beginning of regulation may be influenced thus by the profile of the regulating pin. In such construction, there is a drawback in that the conical pin used for the variation of the toroidal flow area does not always effect a precise course of the characteristic line. Differences in mass production is relatively great. Thus, for example, the pin may be disposed eccentrically in the restrictor bore and in certain circumstances may even contact the bore wall. As a result, movement of the flow regulating piston may be stopped, which in practice has happened.

Moreover, it is very difficult in use of a tapered pin to adjust a desired flow cross section for a certain actuated position of the flow regulating piston by reason of finishing techniques. As a result the governing point at which flow regulation occurs is determined imprecisely.

Another drawback of the prior art is that the tapering pin has a small diameter, especially at the control position for high volume flow. Thus precise production is expensive and such pins may easily break. A further disadvantage of the prior constructions in that flow regulating pistons and pressure relief bores or restrictor bores are aligned coaxially and thus the dimensions of the pumps are correspondingly larger.

Further, the separation of the courses of the characteristic curves for variable pressure conditions and rpms are limited.

For saving power and for avoiding high temperatures, it is desirable especially at high rpms and low pressures in the system, for example, for straight ahead travel at high speeds, to have only a slight oil circulation. However, in a steering movement, i.e., with a high operating pressure, a high flow is required to the power cylinder.

In the German OS No. 24 02 017 (U.S. Pat. No. 3,989,414), a rotary piston pump has been known in which the flow regulating valve with a cylindrically shaped restrictor insert is provided with a restrictor bore. In such construction the separation of the characteristic curves are likewise limited.

BRIEF DESCRIPTION OF THE PRESENT INVENTION

The present invention provides a regulating arrangement of the flow restrictor means type wherein operational characteristic curves may be produced very precisely and simply and with regulation in well separated regions of respective pressure needs and pump speeds. Operation is smooth and with improved uniformity of regulation within narrow limits under changing pressure conditions.

Upon opening movement of the flow regulating piston of the invention at higher pump speeds, the regulation is under control of restrictor bore means which are progressively covered by a flexible leaf spring closure member carried by the piston. Thus, the differential pressure between the two piston surfaces acted upon as described above for the prior art is increased and the piston has a progressive opening movement in releasing pump discharge to a return line. The consequence of this is a dropping characteristic curve at a particular pressure flow upon the regulating point being reached, over the entire pump speed range at that pressure.

The value to which the pump flow being utilized may drop at a maximum pump speed is a matter of design of the size and arrangement of the restrictor bore or bores coacting with a flat surface of the leaf spring as it approaches the bores upon piston movement.

A closure member in the form of a leaf spring permits a precise course of the characteristic curve, since there always is a certain restrictor bore size which can be produced in a precise manner, being merely a bore of uniform size, or, reduced to simplest description an aperture or port or a series of apertures or ports in a surface approached by the closure member.

The restrictor means comprises a cup within the pump housing in the flow passage from pressure chamber to a port for connection to a hydraulic power system having a wall surface against which the leaf spring closure member slides to cover the openings of restrictor bores through the cup wall. This is of particular constructional advantage for simplicity. However, the restrictor bore means could be an integrally cast or molded part of the housing in place of a separate cup.

Provision is made to prevent the leaf spring closure member from rotating out of alignment with the ports of the restrictor bores. For example, arms or keys form side guides between which the leaf spring moves to an fro relative to the insert cup wall surface can be integrally extended from the cup, or flat housing surfaces can be used as side guides to maintain alignment. Whatever guide means one used a slight clearance with the edges of the leaf spring is desirable for sliding contact ease. Other guide means are possible.

The restrictor arrangement operates very reliably and within narrow limits of variation. Furthermore, large separation for the respective operational characteristic curves is had at variable operational pressures, which especially in the case of high pump speed is of great advantage since inherently variation in discharge rate is slight at a low operating pressure.

By using a simple leaf spring as a closure member a continuous closing movement of the restrictor bore means is effected. Thus, as the flat side of the leaf spring approaches the restrictor port or ports in a path axial to the bores thereof, there is a gradual reduction of port opening as the spring, biasedly flexured, flexes against the surface and thus gradually blocks the open area of the port or ports by sliding on the ported surface with a flexing action.

A simple flat surface leaf spring has an advantage in fully closing off a port or ports, or partial closing, for that matter, depending on design of the ported arrangement. Thus, for example, two or three or more restrictor bores may be used which might be closed by the leaf spring partially or fully or any desired combination of partial and full closure.

A detailed description of the invention now follows in conjunction with the appended drawing, in which.

The van pump is essentially of a known construction, wherefore here, only the parts essential for the invention are shown and described.

Figure 1:
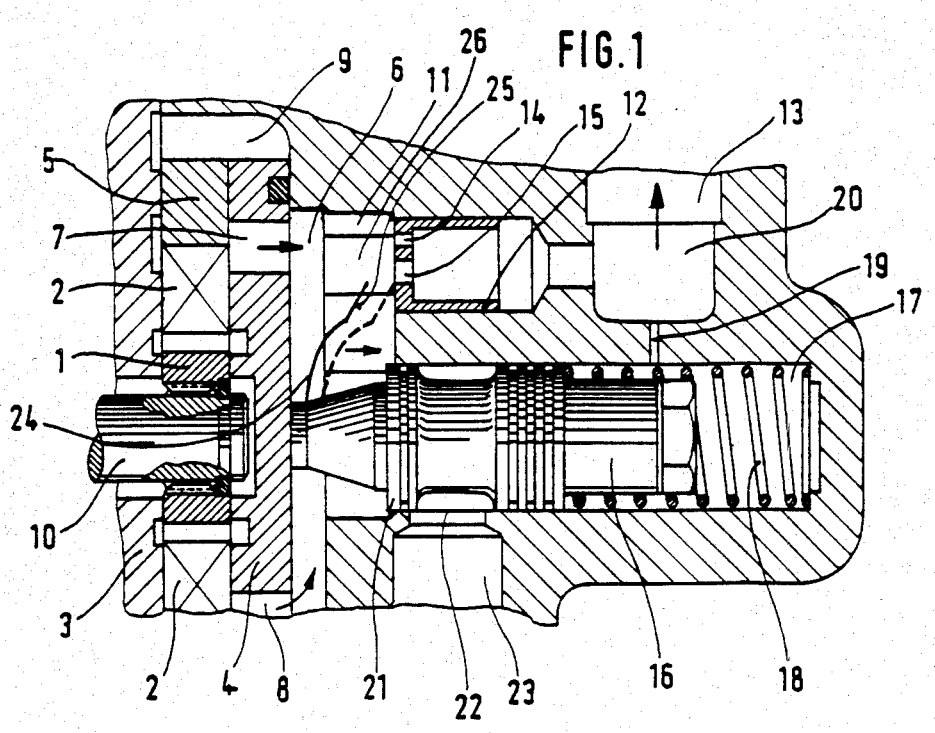
FIG. 1 is a longitudinal section through a vane pump with the regulating device of the invention incorporated therein with the regulating piston shown in closed position.
Figure 2:
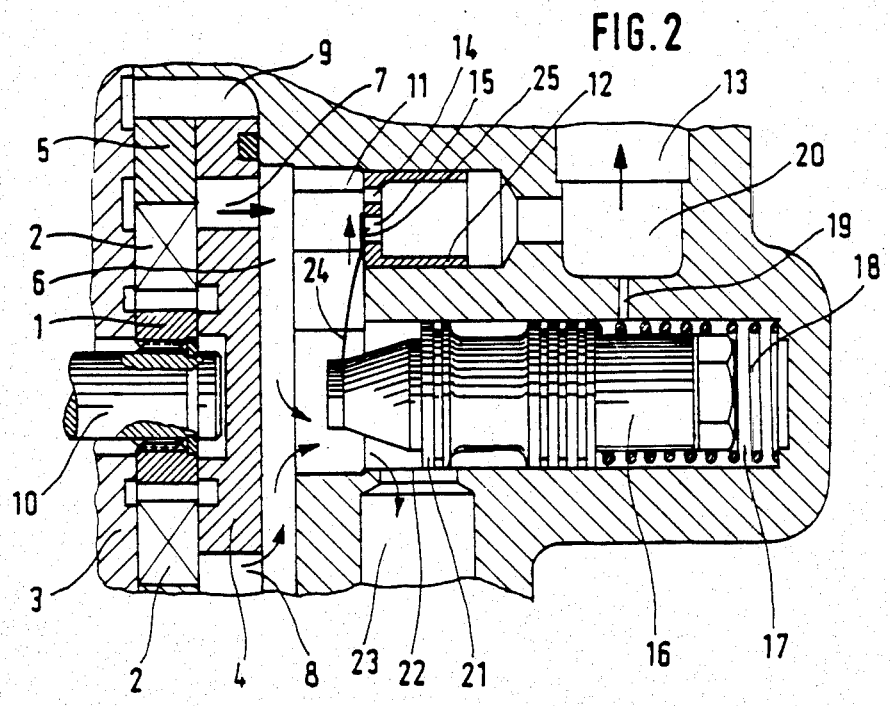
FIG. 2 is a longitudinal section with the flow regulating piston shown in open position.
Figure 3:
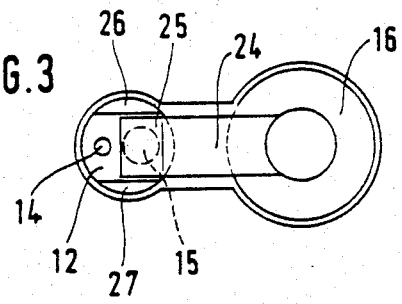
FIGS. 3–7 show, basically, front views of the flow regulating piston and various ported restrictor means.

Referring to FIGS. 1–3, a pump rotor 1 has vanes 2 and is disposed between a forward endplate 3 (only partially shown) and a rear pressure plate 4. The rotor 1 and the vanes 2 are surrounded by a cam ring 5. Downstream of the pressure plate 4, there is an outlet discharge chamber 6 (for pressurized oil) which is connected via pressure passages 7 and 8 with the chamber effected by spacing formed by the rotor 1 and the cam ring 5 on the pressure side. A suction line (not shown) feeds oil from a pump (not shown) into an annular inlet chamber 9. The rotor 1 is splined to the shaft 10 of the vane pump in the usual manner.

Oil under outlet pressure passes through a bore 11 and after passage through a restrictor device 12 flows to an outlet port 13 from which a line connects to a consumer, for example, an auxiliary power steering system.

The restrictor device 12 is a restrictor insert in the housing in the form of a cup having a flat front wall surface through which wall bores 14 and 15 are disposed effecting ports at the surface. Communication from the bore 11 to the outlet port 13 is via the restrictor bores 14 and 15.

A flow regulating piston 16 projects forwardly into pressure chamber 6, abutting the outer surface of the pressure plate 4, a final stop. The flow regulating piston 16 is disposed slidably in a bore of the pump housing which bore has a spring chamber 17 which a spring 18 is disposed effecting a bias on the flow regulating piston 16 in the direction toward the pressure plate 4. The spring chamber 17 is in connection with a pressure chamber 20 by way of a radial bore 19 which chamber is located downstream of the restrictor device 12

Although a specific construction has been shown it will be apparent that modifications may be made. For example, the restrictor cup 12 may be positioned closer to pump outlet passages 7 and 8 to reduce fluid friction, in constrast to the arrangements of the prior art identified hereinabove.

The flow regulating piston 16 has been provided at its upstream or forward portion with a cut-off land 21 downstream of which is a port 22 leading to a flow return conduit 23 for return flow to the suction side of the pump upon opening movement of the piston. Piston 16 carries a throttling flow control restrictor means such as member 24 at the upstream portion in the form of a leaf spring 24 bent at its free end in the direction of the restrictor device 12, the free end having a flat surface 25. The length of the leaf spring 24 is such that it extends at least partly up to restrictor bore 14 or 15. Securing leaf spring 24 to the flow regulating piston 16 may be accomplished in any desired manner.

The member 24 may be of any suitable flexible material such as spring steel or a correspondingly elastic synthetic substance so as to flex flatly against the ported surface of insert 12 to progressively shut off by a throttling or restricting flow through the restrictor bores 14, 15 by a combination of full and partial shutoff.

Securing the leaf spring to the piston can be as indicated in FIGS. 1 and 2 by the bolt head at the right end of the piston, viz., a bolt which will be understood to pass through the piston and through an aperture in the leaf spring, terminating in a thread in the conical member at the left end of the piston. Alternately, welding, soldering, riveting, etc., could be used.

FIGS. 3 to 7 show various arrangements of restrictor bores in the otherwise closed end of restrictor device 12 as well as means for guiding the member 24 in reciprocal movement. Thus, in FIG. 3, a smaller restrictor bore 14 and a larger restrictor bore 15 are provided. Assuming that flow regulator piston 16 has been moved by differential pressure to a position opening flow from pressure chamber 6 to flow return passage 23 (FIG. 2) the closure by flexing action of leaf spring 24 of the restrictor bore 15 is apparent in FIGS. 2 and 3. Accordingly, flow to the consumer device is being regulated by flow only through the restrictor bore 14.

Figure 4:
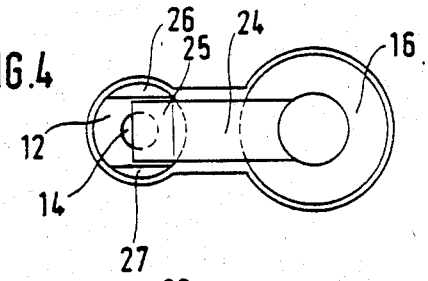

FIG. 4 shows a single restrictor bore 14 covered up partially by the shut-off device 24.

Figure 5:
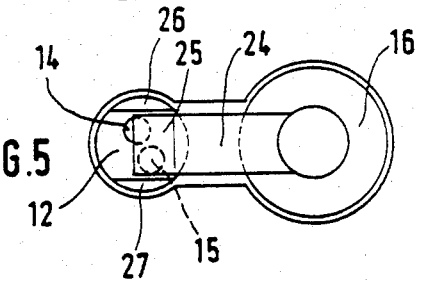

FIG. 5 shows a restrictor bore 15 closed completely and a second restrictor bore 14 closed partially by the shut-off device 24.

Figure 6:
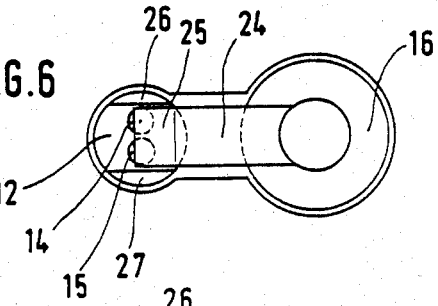

FIG. 6 shows two restrictor bores 14 and 15 disposed substantially side-by-side which are always partially covered up by the shut-off device 24.

Figure 7:
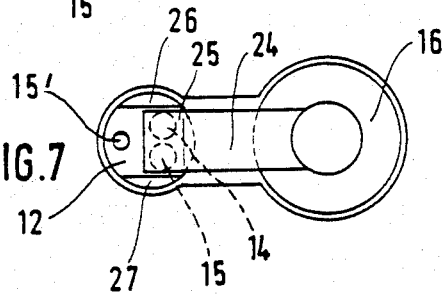

FIG. 7 shows two restrictor bores 14 and 15 completely closed and a third restrictor bore 15' open.

Obviously, a large variety of combinations of restrictor bores are possible for considerable versatility in determining characteristic curves of operation as exemplified in FIG. 8, later discussed.

It is seen in FIGS. 1–7 that for keying leaf spring 24 against misalignment with the restrictor device 12 in which the restrictor bores 14 and 15 are located, two spaced keys 26 and 27 project integrally from insert 12 laterally guiding the sides of the leaf spring 24. Thus, the closure device 24 is prevented from twisting; being guided with slight clearance between the two keys 26 and 27. Of course, other keying and guide devices are possible other than the lateral keys 26 and 27. For example, a pin having a flat side fixed to the housing and protruding into the spring end of the piston 16 in a bore of the same cross section therein to prevent rotation of the piston.

Figure 8:
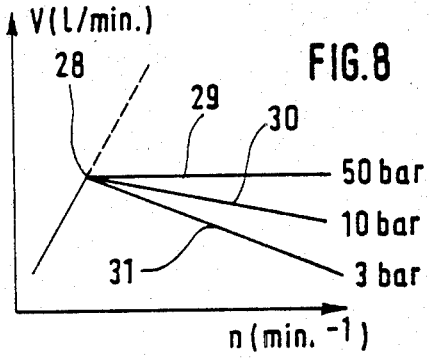
FIG. 8 shows a basic diagram with various characteristic curves of flow.

In FIG. 8, the courses of three characteristic curves for the flow have been shown in principle. The volume discharge of the pump per unit of time (discharge rate) is shown on the ordinate and the rpm of the pump on the abscissa. Up to a governing or regulating point 28, the discharge rate rises to correspond with a rising rpm. Instead of the continued course shown in a broken line, however, a respective regulation takes place on the basis of closure of one or more restrictor bores of restrictor member 12 by the shut-off member 24. Thus, a horizontal regulation curve 29 is shown for an operating pressure of 50 bar for steering power may be achieved, while curves 30 and 31 are exemplary of operating pressures of 10 and 3 bar, respectively. In such instances the discharge rates are lowered.

OPERATION

The flow regulating piston 16 is in the closed position shown in FIG. 1 when the pump is started, the pressure chamber 6 is not connected to return passage 23 via the piston groove due to the position of land 21 of the flow regulating piston 16. Pressure agent coming from the pressure passages 7 and 8, generally oil, flows through all open restrictor bores such as 14 and 15 and through the restrictor device 12 and the pressure chamber 20 and thence by way of the outlet port 13 to, e.g., an auxiliary power steering system.

A pressure differential between the faces of piston 16 exists, i.e., the pressure in chamber 6 on land 21 versus pressure on spring chamber 17 from chamber 20 via restricted bore 19 and acting against the rear lands of the piston. Upon pump speed increase reaching the governing point 28, and as determined by design and choice of restrictor bores as exemplified in FIGS. 3–7, the flow regulating piston 16 receives an opening force. Accordingly, flow occurs from pressure chamber 6, passages 7 and 8, the piston groove, port 22, passage 23 to the suction side of the pump.

The opening movement of the flow regulating piston 16 carries leaf spring 24 toward the open ports of the restrictor bores. It should be noted, depending on the design of the forward end of the leaf spring, before actual contact with the closed end of restrictor member 12, the approach to the ports can produce a throttling effect by narrowing the passage of flow between the end of the member 24 and the restrictor bore ports. This effect may be utilized for regulation independently of or with utilization of the restrictor ports.

However, upon engagement of end 25 with insert 12 the movement of end 25 becomes transverse to the axis of the bores to effect a precise and gradual flow shut off through the restrictor bores.

Thus, a throttling effect is caused by the bend in the spring 24 and the end planar surface 25 with a selected arrangement of restrictor bores, in keeping with the length of the spring. Initially the end 25 engages the front of insert 12 in an intermediate position shown in dotted line in FIG. 1. Upon further movement of piston 16 the end 25 is flexed to slide flat in a sweeping action over and against the ported area as seen in FIG. 2, sliding in the direction of the arrow.

A gradual throttling thus results by closing the ports of the restrictor bores with movement of piston 16.

When, a consumer system is put in use, e.g., a hydraulic steering is operated, the flow regulating piston 16 has closing pressure due to pressure via the bore 19 from chamber 20 effecting pressure in the spring chamber 17. The result is a whole or partial opening of the restrictor bore means. Thus, when steering at upper pump speeds, a larger volume of oil is available which ensures a sufficient steering rate.

Referring now to FIG. 8, curve 31 represents the operating pump outlet pressure essentially without steering movement. Thus, at high road speeds on open highways pump speeds are high but discharge through a circulatory system is low. Now, however, upon a steering movement at high speed, circulatory flow ceases and the operating pressure rises up to 50 bar, accompanied by increased discharge rates along the curve 29. Thus, a sufficient pump discharge is available for steering, at a rapid steering rate. If the leaf spring 24 is made of sufficient stiffness the spring 18 may possibly by omitted. Accordingly, upon a drop in opening pressure acting on regulating piston 16, acting to permit closure of port 22, a leaf spring 24 of suitable stength and length may be usable to return the flow regulating piston 16 from the position shown in FIG. 2 to the position shown in FIG. 1.

In summary, normally when there is no demand for high pressure in the booster steering system, during non-steering, the manually operable control valving for the power cylinder permits low pressure and low discharge rate circulation from pump to sump, illustrated by curve 31, FIG. 8. Thus, regulating means, e.g., restrictor bores 14 and 15 being fully open, there is insufficient pressure in the pressure chamber 6 to shift the regulator piston 16 to release pump discharge through the return line 23 to the suction side of the pump. Spring 18 provides the bias to maintain this condition of closure of return passage 23 at this time.

Operation under such conditions involves little use of energy. This can occur at any low pump speed. Should speed rise in high speed driving, to a predetermined point 28, the pressure then acting on the regulating piston will shift it to open the return passage 23 and the pressure chamber discharges, causing pressure drop. All this occurs during non-steering operation.

If the steering valve is operated for pressurizing a power cylinder, the low pressure circulation ceases and now high pressure flow occurs since oil is causing a pressure build up in a cylinder chamber against the resistance of the steering mechanism.

Accordingly, the back pressure on the opposite side of the regulator piston 16 via chamber 20 and narrow bore 19 causes regulator piston actuation to close passage 23. A full pressure build up now occurs and at a high discharge rate as illustrated by curve 50, thus rendering power steering effective by flow through fully open restrictor bores 14, 15.

Curve 29 represents a rapid steering operation at high pump speeds as compared with curve 30 representing a somewhat slower steering operation at increasing pump speeds wherein the discharge rate would be lower under power cylinder valving control at the steering wheel. Regulating by actuation of the regulator piston then becomes operative by the progressive restricting of flow through the restrictor bores to maintain a requisite flow rate.

I claim:

1. In a displacement vane pump flow regulator device for a hydraulic power system wherein a pump has a housing with outlet pressure chamber (6) to communicate with a differential pressure actuated regulating piston (16); including flow restrictor means (12,24) having restrictor passage means (14, 15, 15') for pump pressure flow to a hydraulic power system; means (22, 23) whereby outlet chamber pressure actuation of said regulator piston permits pressure flow from said outlet pressure chamber to a pump suction return line and means (19, 20) whereby pressure in said hydraulic power system effects piston actuation to shut-off said latter flow;

the improvement wherein said restrictor passage means comprises at least one restrictor bore normally open to communicate said pump pressure chamber to said hydraulic power system;

said flow restrictor means comprising closure means (24, 25) operated by said regulator piston to progressively at least partially shut off flow through said restrictor bore when said regulator piston is pressure actuated by pressure from said outlet pressure chamber, wherein said closure means comprises a closure member (25) disposed to move across the flow area of said restrictor bore with movement of said regulator piston in progressively restricting flow through said area; wherein said closure means and said restrictor bore coact to effect flexibility of closure engagement;

said bore having an open port in a plane intersecting the axis of said regulator piston and wherein said closure means comprises a member slidable across and flexibly biased against said port.

2. In a regulator device as set forth in claim 1, a wall means in said pump housing through which said bore passes and said wall having said port;

said closure means comprising a flexible member slidable across said port to restrict flow passage therethrough.

3. In a regulator device as set forth in claim 2, wherein said flexible member comprises a leaf spring (24) carried by said regulator piston and having a flat surface (25) disposed to be slidable across said port with movement of said piston.

4. In a regulator device as set forth in claim 1, said closure member comprising a leaf spring (24) carried by said regulator piston and bent in the direction of said restrictor bore and having a planar portion extending from said bent portion to move over said flow area.

5. In a displacement vane pump flow regulator device for a hydraulic power system wherein a pump has a housing with outlet pressure chamber (6) to communicate with a differential pressure actuated regulating piston (16); including flow restrictor means (12, 24) having restrictor passage means (14, 15, 15') for pump pressure flow to a hydraulic power system; means (22, 23) whereby outlet chamber pressure actuation of said regulator piston permits pressure flow from said outlet pressure chamber to a pump suction return line and means (19, 20) whereby pressure in said hydraulic power system effects piston actuation to shut-off said latter flow;

the improvement wherein said restrictor passage means comprises at least one restrictor bore normally open to communicate said pump pressure chaber to said hydraulic power system;

said flow restrictor means comprises closure means (24, 25) operated by said regulator piston to progressively at least partially shut off flow through said restrictor bore when said regulator piston is pressure actuated by pressure from said outlet pressure chamber, wherein said closure means comprises a closure member (25) disposed to move across the flow area of said restrictor bore with movement of said regulator piston in progressively restriction flow through said area; said pump having a wall and said restrictor passage means comprising at least one restrictor bore therethrough and effecting a port over the planar area of which said closure member flexible sweeps biasedly flexured against said wall.

6. In a regulator device as set forth in claim 5, said wall having a plurality of restrictor bores therethrough with ports arrayed for predetermined area closure by movement of said closure member.

7. In a regulator device as set forth in claim 5, an insert in said pump housing effecting said wall.

8. In a regulator device as set forth in claim 7, said insert (12) being cup-shaped, said pump housing having a bore communicating with said outlet pressure chamber and comprising passage means (13) for connection to a hydraulic power system, said insert being in said bore.

9. In a displacement vane pump flow regulator device for a hydraulic power system wherein a pump has a housing with outlet pressure chamber (6) to communicate with a differential pressure actuated regulating piston (16); including flow restrictor means (12, 24) having restrictor passage means (14, 15, 15') for pump pressure flow to a hydraulic power system; means (22, 23) whereby outlet chamber pressure actuation of said regulator piston permits pressure flow from said outlet pressure chamber to a pump suction return line and means (19, 20) whereby pressure in said hydraulic power system effects piston actuation to shut-off said latter flow;

the improvement wherein said restrictor passage means comprises at least one restrictor bore normally open to communicate said pump pressure chamber to said hydraulic power system;

said flow restrictor means comprising closure means (24, 25) operated by said regulator piston to progressively at least partially shut off flow through said restrictor bore when said regulator piston is pressure actuated by pressure from said outlet pressure chamber, wherein said closure means comprises a closure member (25) disposed to move across the flow area of said restrictor bore with movement of said regulator piston in progressively restricting flow through said area; wherein said closure means comprises a leaf spring (24) carried by said regulator piston and having a flat surface (25) disposed to be slidable across said port with movement of said piston; guide means (26, 27) in said housing slidably engageable by said leaf spring to maintain alignment thereof with said port.

10. In a regulator device as set forth in claim 9, an insert in said pump housing having a wall and said bore being in said wall and terminating in a port wherein said wall is slidably traversed by said leaf spring to progressively restrict flow through said port; said guide means being at least one key member (26) extending integrally from said wall slidably engageable with said leaf spring.

11. In a regulator device as set forth in claim 9, said guide means comprising a pair of parallel key members slidably engageable with said leaf spring.

12. In a regulator device as set forth in claim 9, a cup-shaped insert (12) in said pump housing and comprising said wall; said guide means comprising key means extending integrally from said insert for slidable guide engagement with said leaf spring.

* * * * *